US012137785B2

(12) United States Patent
Sung et al.

(10) Patent No.: US 12,137,785 B2
(45) Date of Patent: Nov. 12, 2024

(54) HAIRDRYER AND METHOD OF USE

(71) Applicant: Kiss Nail Products, Inc., Port Washington, NY (US)

(72) Inventors: Siyong Sung, Roslyn Heights, NY (US); Taehoon Kim, Huntington Station, NY (US); Hyung Seung Song, Bayside, NY (US); Robert Kim, Tuxedo Park, NY (US); Sungyoul Kim, Flushing, NY (US); Sunglyul Park, Osan-Si (KR)

(73) Assignee: Kiss Nail Products, Inc., Port Washington, NY (US)

( * ) Notice: Subject to any disclaimer, the term of this patent is extended or adjusted under 35 U.S.C. 154(b) by 511 days.

(21) Appl. No.: 17/493,527

(22) Filed: Oct. 4, 2021

(65) Prior Publication Data

US 2022/0104598 A1 Apr. 7, 2022

Related U.S. Application Data

(60) Provisional application No. 63/087,107, filed on Oct. 2, 2020.

(51) Int. Cl.
*A45D 20/12* (2006.01)

(52) U.S. Cl.
CPC ..... *A45D 20/12* (2013.01)

(58) Field of Classification Search
CPC ..... A45D 20/12
USPC ..... 34/283, 95–100
See application file for complete search history.

(56) References Cited

U.S. PATENT DOCUMENTS

| | | | | |
|---|---|---|---|---|
| 778,888 | A * | 1/1905 | Peter et al. | A45D 20/12 34/97 |
| 1,639,753 | A * | 8/1927 | Shelton | A45D 20/14 362/253 |
| 4,019,260 | A * | 4/1977 | Levy | A45D 20/122 239/389 |
| 5,546,674 | A | 8/1996 | Lange et al. | |
| 5,651,189 | A * | 7/1997 | Coykendall | F26B 21/001 34/91 |
| 5,787,601 | A | 8/1998 | Stelly | |
| 6,011,903 | A | 1/2000 | Nosenchuck | |
| 6,148,537 | A | 11/2000 | Altamore | |
| 6,191,930 | B1 | 2/2001 | Ramchandani | |
| 6,449,870 | B1 | 9/2002 | Perez et al. | |
| 7,047,660 | B2 | 5/2006 | Leventhal | |
| 8,272,142 | B2 | 9/2012 | Hall | |
| 8,601,713 | B2 | 12/2013 | Gaillard et al. | |
| 10,021,951 | B2 | 7/2018 | Bobillier et al. | |
| 10,492,585 | B2 * | 12/2019 | Weatherly | A45D 20/12 |

(Continued)

FOREIGN PATENT DOCUMENTS

| | | | | |
|---|---|---|---|---|
| CN | 102410570 A | 4/2012 | | |
| EP | 2461714 B1 * | 12/2020 | | A45D 20/12 |

(Continued)

*Primary Examiner* — Stephen M Gravini
(74) *Attorney, Agent, or Firm* — Cherskov Flaynik & Gurda, LLC

(57) ABSTRACT

A hairdryer is described. The hairdryer includes an air intake aperture which has a variable airflow cross section. The hairdryer also includes an air expulsion aperture with a fan positioned between the air intake aperture and the air expulsion aperture. The air intake aperture is adapted to regulate amount of air flowing out of the air expulsion aperture.

10 Claims, 8 Drawing Sheets

(56) References Cited

U.S. PATENT DOCUMENTS

| | | | | |
|---|---|---|---|---|
| 11,641,918 | B2 * | 5/2023 | Jeong | H05B 3/145 34/97 |
| 11,751,657 | B2 * | 9/2023 | Friedman | H01M 10/6563 34/97 |
| 2010/0064542 | A1 | 3/2010 | Mulvaney et al. | |
| 2022/0104598 | A1 * | 4/2022 | Sung | A45D 20/12 |

FOREIGN PATENT DOCUMENTS

| | | | | |
|---|---|---|---|---|
| JP | 2006051181 | A | 2/2006 | |
| JP | 2006130181 | A | 5/2006 | |
| WO | WO-2011016729 | A1 * | 2/2011 | A45D 20/12 |

* cited by examiner

HAIRDRYER AND METHOD OF USE

This application claims priority to U.S. Provisional application 63/087,107, filed on Oct. 2, 2020, the contents of which are hereby incorporated by reference.

BACKGROUND OF THE INVENTION

1. Field of the Invention

This invention relates to a hairdryer, and more specifically, this invention relates to a hairdryer that utilizes regulated airflow to control the interior air pressure.

2. Background of the Invention

Hairdryers are common, but prior art devices share common drawbacks. One serious drawback to prior art devices is the significant noise output, particularly among hand-held dryers. This is partially due to the circuitous route of intake air through hand-held dryers. Lastly, variable fan speeds often used lead to premature breakdown.

Attempts have been made to lessen the noise associated with hairdryers, among them reducing airflow velocities through the expulsion point of the dryers. Another approach has been to reduce the fan speed. However, drying efficiencies suffer as a consequence.

A need exists in the art for an efficient hairdryer and a more efficient method for drying hair. An ideal device will vary the air expelled from it, not by varying fan speed but by varying airflow into the device. A user should be able to vary the input air volume to a minimal to a maximum amount while not changing the speed of the fan housed within the hairdryer.

SUMMARY OF INVENTION

An object of the invention is to provide a device and method for transporting and heating air through a hairdryer that overcomes many of the drawbacks of the prior art.

Another object of the invention is to provide an efficient device and method for drying hair. A feature of the invention is the use of a variable flow cross-section air intake. An advantage of the invention is that the variable flow regulates the amount of air contacting and heating the hair of the user.

Yet another object of the invention is to provide a hand-held hairdryer that minimizes operational noise. A feature of the invention is an air intake baffle that increases or decreases fan speed, depending on baffle settings. An advantage of the invention is the smoothing of fan speed variations, thereby extending component life.

An object of the invention is to facilitate airflow adjustment without requiring additional powered elements. A feature of the invention is that the baffle can be adjusted directly by the end-user during use. An advantage of the invention is that the baffle is user-accessible and does not require electronic control.

Briefly, the invention provides a hairdryer comprising; an air intake aperture having a variable flow cross-section, an air expulsion aperture; and a fan positioned between the air intake aperture and the air expulsion aperture, whereby modification of the air intake aperture simultaneously modifies the speed of the fan.

Also provided is a method for transporting air through a hairdryer, the method comprising supplying an air ingress port having a variable flow cross-section port; supplying an air egress port in fluid communication with the air ingress port; and regulating airflow rate out of the egress port by varying the flow cross-section.

BRIEF DESCRIPTION OF DRAWINGS

The invention, together with the above and other objects and advantages, will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings.

All numeric values are herein assumed to be modified by the term "about", whether or not explicitly indicated. The term "about" generally refers to a range of numbers that one of skill in the art would consider equivalent to the recited value (e.g., having the same function or result). In many instances, the terms "about" may include numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

The following detailed description should be read with reference to the drawings in which similar elements in different drawings are numbered the same. The drawings, which are not necessarily to scale, depict illustrative embodiments and are not intended to limit the scope of the invention.

As used herein, an element or step recited in the singular and preceded with the word "a" or "an" should be understood as not excluding plural said elements or steps, unless such exclusion is explicitly stated. As used in this specification and the appended claims, the term "or" is generally employed in its sense including "and/or" unless the content clearly dictates otherwise.

Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

While the figures accompanying this specification depict a hand-held hairdryer, the inventive concept of modifying incoming airflow via the modification of airflow surface area of the mouth of the air input port can be applied to stationary dryers as well.

The invention comprises a hairdryer that varies airflow into its housing to make hair drying more efficient. Not only does the dryer operate at lower noise levels, but the dryer also operates at a lower wattage to provide higher heated airflow to the user.

A feature of the invention is that it provides the user with the capability of manually modifying the cross-section of an air intake port during operation to vary the airspeed to the heating element, and therefore the speed of the air and temperature of the air to the user's hair. Another feature is that the fan speed is determined by the cross-section selected by the user. Alternatively, the fan speed may be set independently of the setting of the cross-section of the air intake port.

Figure 1A:
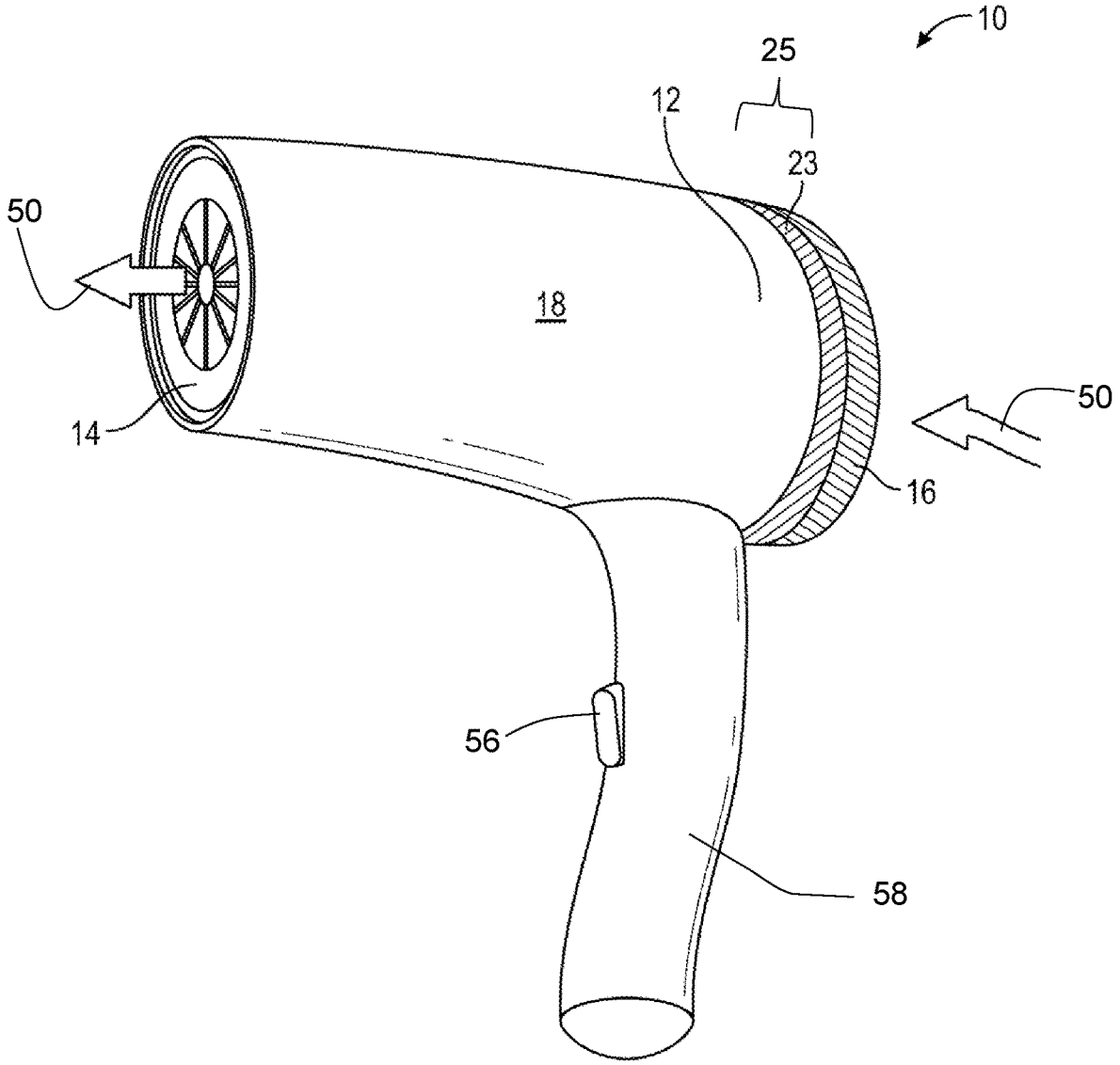
FIGS. 1A and 1B are isometric views of different embodiments of a hairdryer, in accordance with features of the present invention.
Figure 2A:
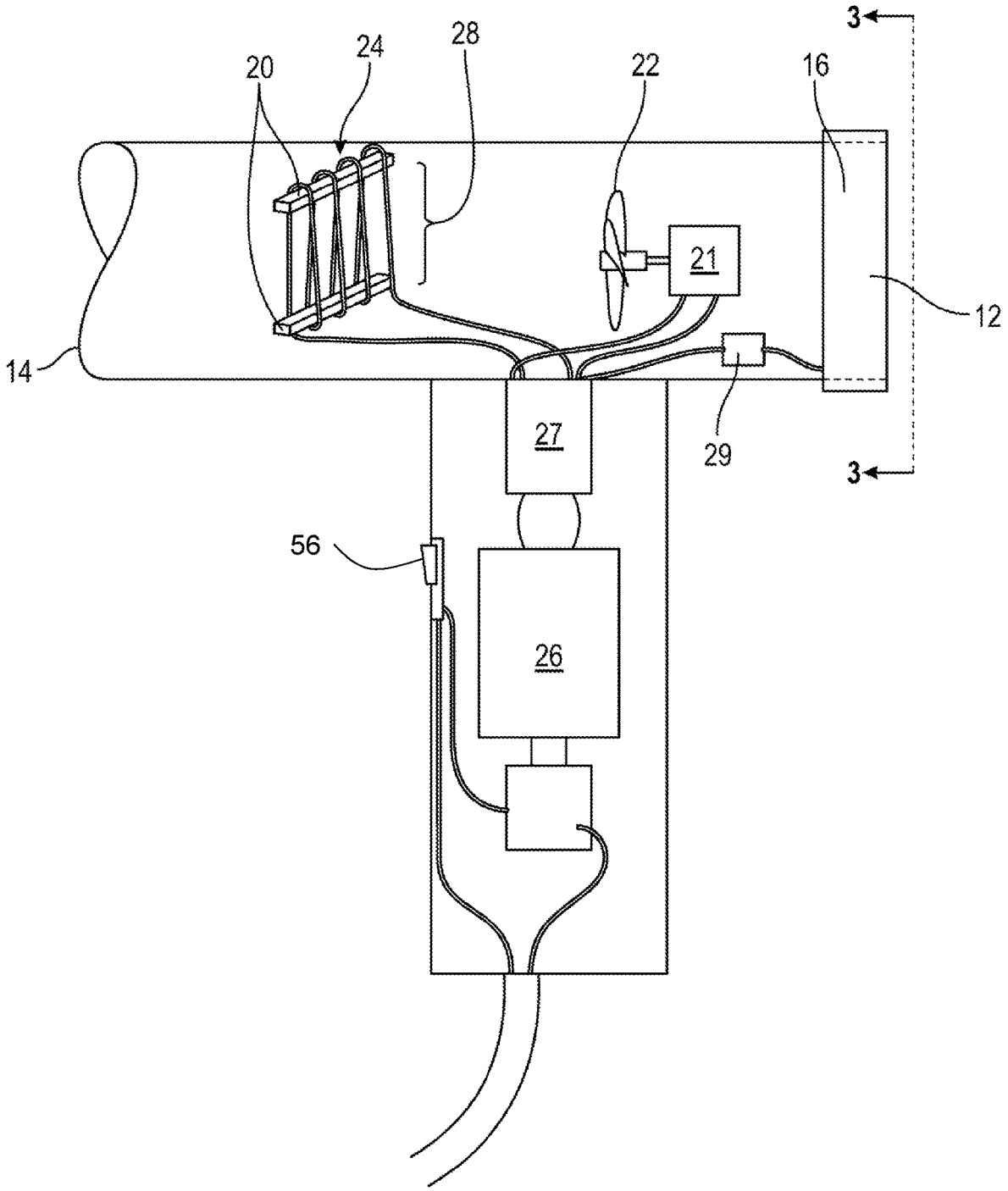
FIGS. 2A and 2B are detailed elevational views of a hair drawer; in accordance with features of the present invention.
Figure 2B:
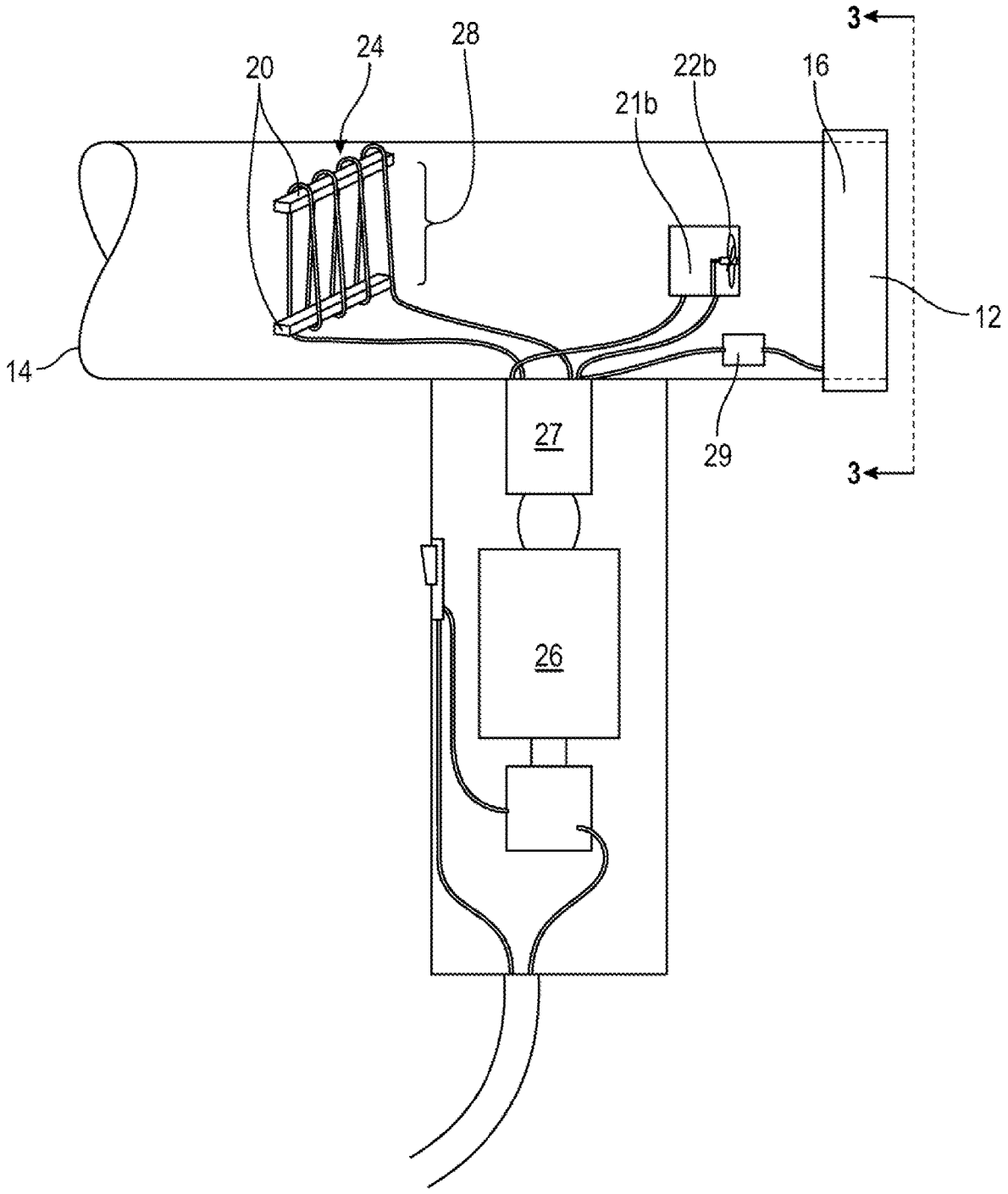

FIG. 1A is an elevational view of an embodiment of the hairdryer 10. The hairdryer 10 comprises a first air take region 12 and a second air expulsion region 14. The airflow 50 in FIG. 1A is shown using the arrows. While the air intake region is shown in FIGS. 1A and 2A and 2B positioned upstream of the air expulsion region, other configurations are possible, including the positioning of the air intake region proximal to the air expulsion region or to the side of the air expulsion region or even forward of the air expulsion region.

The hairdryer 10 comprises a nacelle portion 18 and a handle portion. The handle portion 58 includes the power switch 56. The interior details of each portion will be described below. A power cord (not shown) extends from the handle portion in embodiments that are hardwired. In at least some embodiments, the hairdryer 10 is powered by a rechargeable battery pack, either alone or in conjunction with a wireless power source, such as a long-distance wireless power transfer device using inductive charging over sufficiently long distances. In such an embodiment, handle portion 58 includes a wireless power antenna or coil.

A salient feature of the invention is that in whatever position the air intake region is located, it features a variable intake vent 25, which defines a cross-section surface area that can be modified by the end-user. One means for modifying the cross-section is by positioning the baffle 16 with regards to the fluted surface 23. By adjusting one element with regards to the other, the vent 25 has infinite adjustment airflow adjustment points. The vent 25 may be fully closed such that no air enters the air intake vent, or fully open such that airflow is minimally hindered through the vent. When the vent is fully closed, outside air may be drawn into the device through its air expulsion port 14 as a result of the force of the fan encapsulated by the nacelle or housing 18 of the dryer.

In the embodiment of FIG. 1A, the position of the vent 25 is controlled by adjusting the position of the baffle 16 with regards to the fluted surface 23. The details of the operation of the adjustable vent 25 are described below.

Figure 3A:
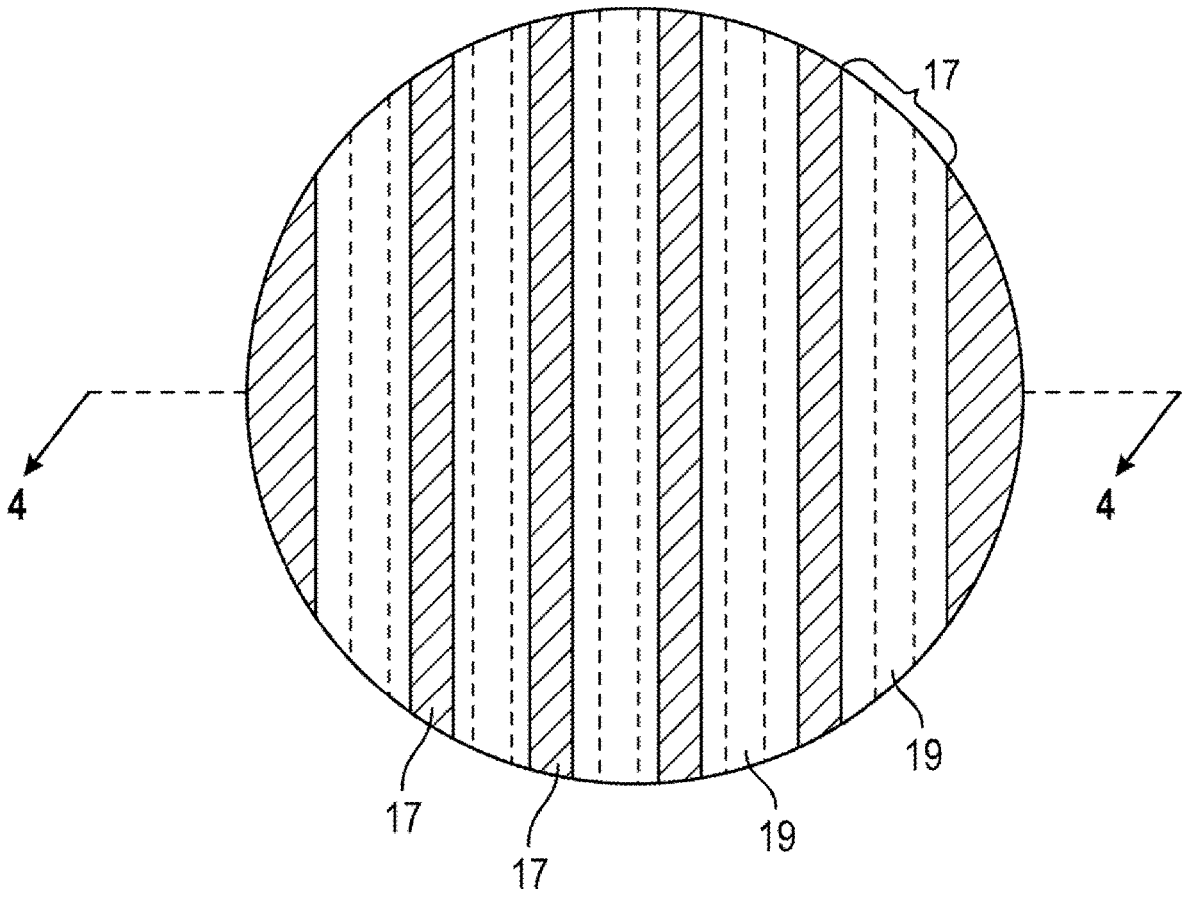
FIG. 3A is a view along line 3-3, depicting an air intake baffle fully open; in accordance with features of the present invention.
Figure 3B:
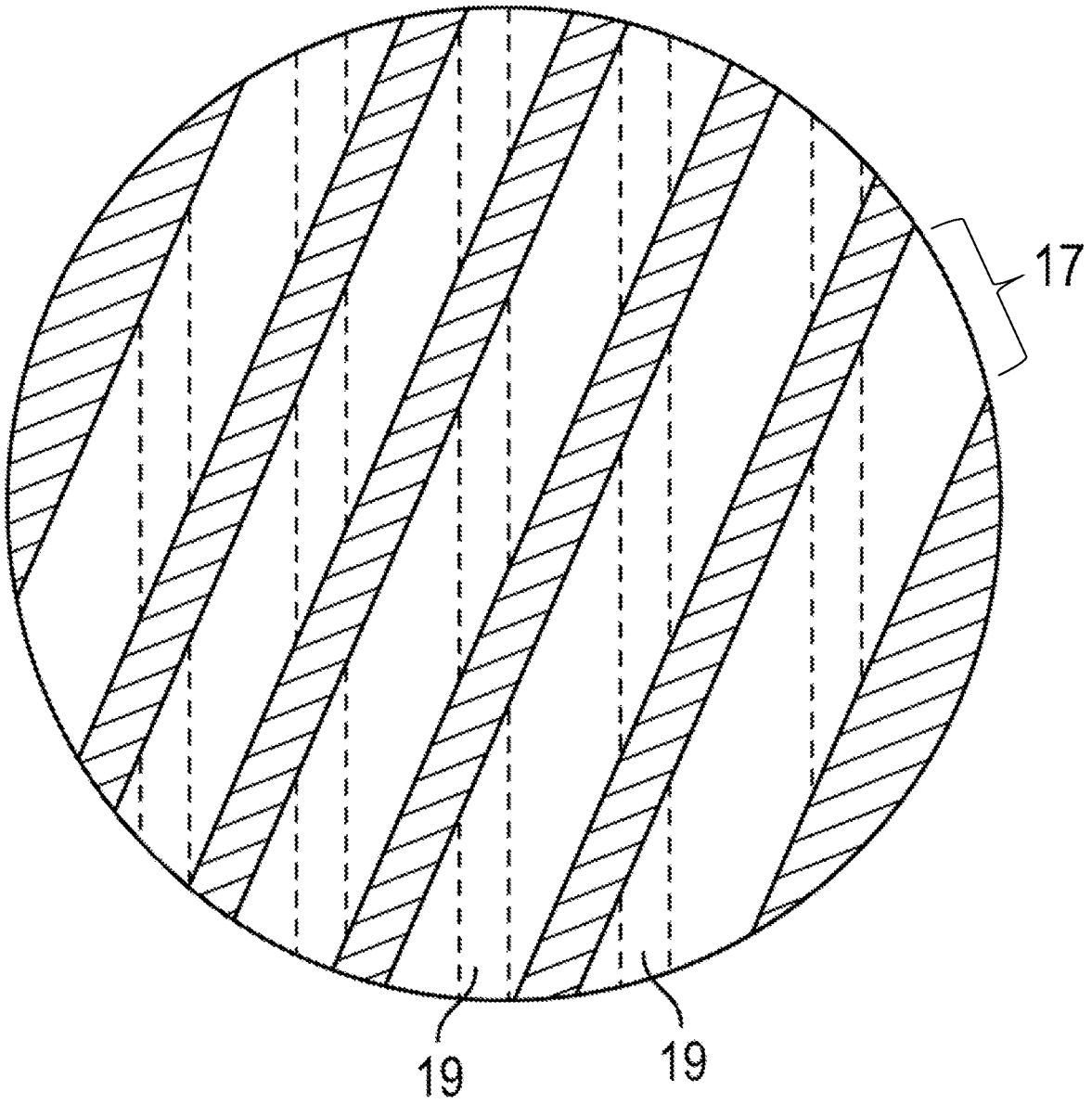
FIG. 3B is a view along line 3-3, depicting air intake baffle approximately half-closed, in accordance with features of the present invention.
Figure 3C:
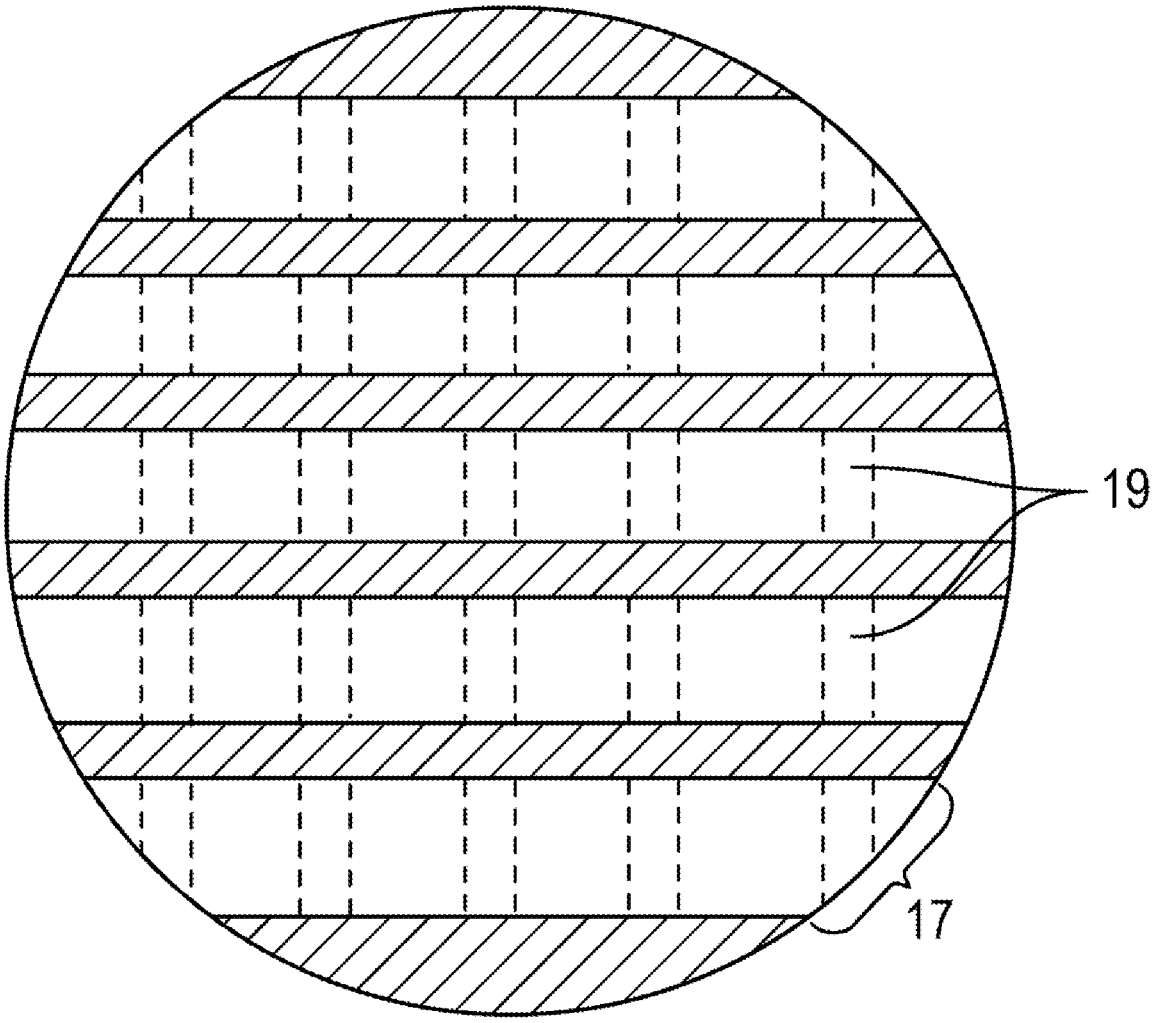
FIG. 3C is a view along line 3-3, depicting air intake baffle in minimal flow configuration, in accordance with features of the present invention.

For example, as depicted in FIG. 3A, the slots 17 of the baffle are shown in substantially maximum flow configuration. However, and as depicted in FIGS. 3B and 3C, a dial or cover overlaying or positioned superior to the baffle may be rotated or otherwise manipulated by the user to either partially or fully close the cross-section surface area of the air intake port.

Figure 1B:
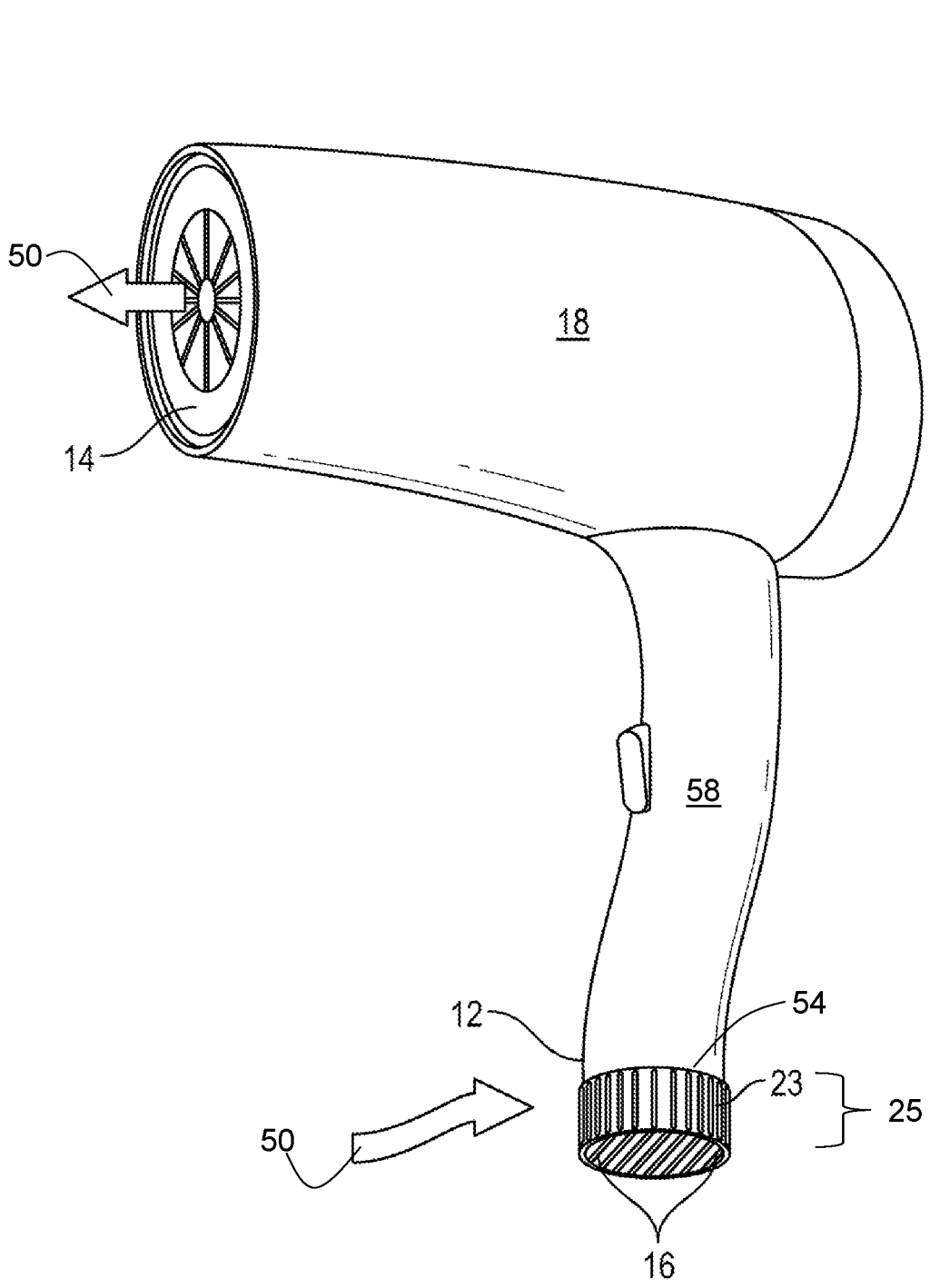

FIG. 1B depicts an alternative embodiment of the hairdryer 11. In this hairdryer, the baffle 16 is positioned at the depending end 54 of the handle 58 of the dryer. The air intake port 12 is therefore also located at the depending end 54. The airflow 50 enters through the vent 25, comprising the combination of baffle 16 and the fluted surface 23, exiting the expulsion region 14. The embodiment 11 depicts the air input port 12 in perpendicular registration to the air expulsion port.

FIG. 2A shows the internal mechanism of an embodiment of the invented hairdryer. In this embodiment, the air input port 12 of the dryer is positioned "upstream" from the air expulsion port 14 in a linear relationship thereto such that the input port 12 and the air expulsion port 14 are on the same linear axis. An embodiment where the input port is perpendicular to the expulsion port, such as the embodiment shown in FIG. 1B uses a different internal arrangement.

A fan 22, its associated motor 21, and a heating element 24 positioned downstream from the fan, are located between the air input port and the expulsion port 14, such that the fan and both air input and output ports lie along the same axis. This arrangement, plus the positioning of the fan upstream of the heating element, optimizes cooling to the fan motor by preventing heat from the heating element from contacting the fan and fan motor. It should be noted that while the fan motor is shown positioned upstream of the fan, the motor may be positioned upstream of the fan so as to be between the baffle and the fan.

In the depicted embodiment, the heating element 24 comprises wires mounted on holders 20. In one embodiment, the wires comprise a grid of nichrome wires 28. The grid of nichrome wires 28 is suspended between the holders 20 comprising mica board supports, in one embodiment. While FIG. 2A shows the wires as having substantially straight segments suspended between the supports, in other embodiments, not shown, the wires comprise a coil.

In one embodiment, the power switch 56 controls only the amount of power provided to the heating element 24 and whether motor 21 is engaged. In one embodiment, the power switch 56 does not control the speed of the motor, which is maintained at a constant velocity. Instead, the airflow is controlled by the position of the baffle 16.

In one embodiment, shown in FIG. 2B, the motor comprises a brushless DC electric motor 21*b*. A benefit of such a motor is that it has a smaller footprint and can be located in a number of possible locations within the main body of the hairdryer. Further, in this embodiment, the placement of the DC electric motor 21*b* and the fan 22*b* can be reversed, resulting in the orientation of components as shown in FIG. 2B. As the brushless DC electric motor 21*b* is much smaller than a conventional motor, such as the motor 21 shown in FIG. 2A, the airflow will not be impeded. The fan 22*b* is therefore further separated from the expulsion port 14, further decreasing the noise for the end user. In the embodiment shown in FIG. 2B, the brushless DC electric motor 21*b* and the fan 22*b* are integrated into one unit, decreasing the complexity of the system and decreasing vibration within the system.

In the embodiment of FIG. 2B, the transformer 26 will provide the appropriate voltage for the brushless DC electric motor 21*b*, as well as appropriate voltage for the heater elements, such as the wire grid 28. In one embodiment, the heater elements operate on direct AC line voltage while the motor operates on DC transformer voltage.

Airflow Rate Control Detail

The invented adjustable vent is more energy-efficient, can vary fan speed, and can vary expelled air temperatures. The baffle is designed to be actuated to any of an indefinite number of positions between a fully closed position and a fully open position. Baffle actuation may include a user rotating the baffle or a surface overlaying the baffle, to effect aperture sizes defining the baffle.

Most of a typical hairdryer's energy usage is by the heating element. By calibrating the heating element so that an optimum amount of heat is applied for a given amount of air intake, electricity usage can be optimized, resulting in less heating of the element.

Resonance issues (which result in noise) are also improved by the invented baffle. Noise is maximized when the frequencies of the in-rushing air and the hairdryer operation match. However, the inventors have found that noise reduction and even cancellation can occur by controlling the hairdryer operation (e.g., fan speed frequencies) relative to the baffle opening size (i.e., frequency from wind). For example, having the baffle in a wide-open configuration while the fan is at low-speed results in a maximal reduction in noise.

Surprisingly and unexpectedly, positioning the fan 22 in close spatial relationship to the intake baffle provides additional means for varying the fan speed based on the selected configuration of baffle apertures. The baffle rotation mechanism provides a means for varying the temperature and fan speed precisely inasmuch as it is akin to an analog dial. (Preset switches or digital switches have tactile click points and therefore preset temperatures and speeds.) For example, as the apertures of the baffle are further increased in size by the user, more air is admitted into the nacelle 18, thereby allows for an increase in fan speed. The opposite is true, such that constricting the apertures of the baffle reduces airflow and, therefore fan speed.

A means for lowering heating element temperature (such as a rheostat 29) in electrical communication with the baffle actuating mechanism is provided in instances where the end-user requires lower airflow and simultaneously lower air temperatures. Conversely, a means for increasing heating element temperature is provided in instances where the user wants to combine high airflow velocities and/or volumes with high airspeeds. Additionally, through alternative switching, the rheostat 29 may vary fan speed based on the opening sizes of the baffle. In this instance, the fan motor rotation speed is varied by the rheostat. The rheostat 29 may be in electrical communication with either or both the fan motor 21 and/or the leads to the heating element 24 via a junction box 27 positioned proximal to the transformer 26.

For further fan speed and/or airspeed variance, intake airspeed may be modified by inwardly facing surfaces of the nacelle 18 located between the fan and the baffle defining convex surfaces. Such surfaces impart a venturi effect, thereby increasing airspeed.

Airspeed controlled by baffle apertures results in changes in the temperature of the air expelled from the air output port 14. Higher air velocities impinging upon the heater 24 will result in lower air temperatures emitted from the output port 14. Conversely, relatively lower air velocities impinging upon the heater 24 will result in higher air temperatures.

An added benefit to the invented baffle design is that the outward-facing surface of the baffle may change appearance as the baffle is rotated. For example, a logo or other visible indicia may appear and disappear as the baffle is rotated. It is envisioned that when the baffle is opened fully such that the apertures are at their widest, indicia may suggest increasing the temperature of the heating element. Alternatively, when the baffle is mostly closed, indicia may suggest decreasing the temperature of the heating element and/or modifying the fan speed.

The heating element may comprise a Nichrome wire grid 28 energized by a step-up transformer 26, as depicted housed within the handle of the dryer. The Nichrome wire 28 may be supported by mica board support substrates 20. These substrates also serve as a thermal and electrical insulator, inasmuch as the substrates, shown as elongated and transversely extending supports, contact, and are anchored into, the nacelle 18.

FIGS. 3A-C are views taken along line 3-3 of FIG. 2A or FIG. 2B. FIG. 3A shows the air input port baffle in its fully opened position, whereby slots 17 of the baffle 16 align with slots 19 (shown as dashed lines) integrally formed in the heel end (i.e., upstream end) of the dryer nacelle.

FIG. 3B shows the baffle partially opened, such that its slots 17 are turned at a 45-degree angle to the slots 19 formed in the heel end of the dryer nacelle. FIG. 3C depicts a nearly fully closed baffle. A means for actuating the baffle may include a dial defining a fluted surface 23, as shown in FIG. 1A. The dial may include specific setpoints so as to provide a plurality of airflow settings upon tactile feedback to the user. Alternatively, the dial may provide for infinite flow settings, further customizing the airflow handling feature of the device to the user. Exterior peripheral regions of the dial may be smooth, fluted, or otherwise modified to modify the frictional engagement between the dial and the user.

FIG. 3C shows the baffle 16 rotated a full 90 degrees, such that minimal airflow is passing through the baffle's slots 17 and through the nacelle's slots 19. It is noteworthy that in one embodiment, the baffle 16 does not completely shut out the airflow so as to minimize thermal damage to the internal mechanism of the dryer during operation when the nichrome wire 28 is energized.

While the baffle is shown in FIG. 1B positioned at the depending end of the handle 58 of the dryer, the air intake port and therefore the baffle may be positioned elsewhere for example, at the end of the nacelle 18 opposite the air expulsion end 14, as shown in FIGS. 1A, 2A, and 2B. The baffle adjustment cover 32 may be similarly positioned. Alternatively, the dial or other baffle modifying means (e.g., a toggle switch or electronic switch), may continue to be positioned along the handle such that the user may adjust airflow while continuing to use the device.

Figure 4:
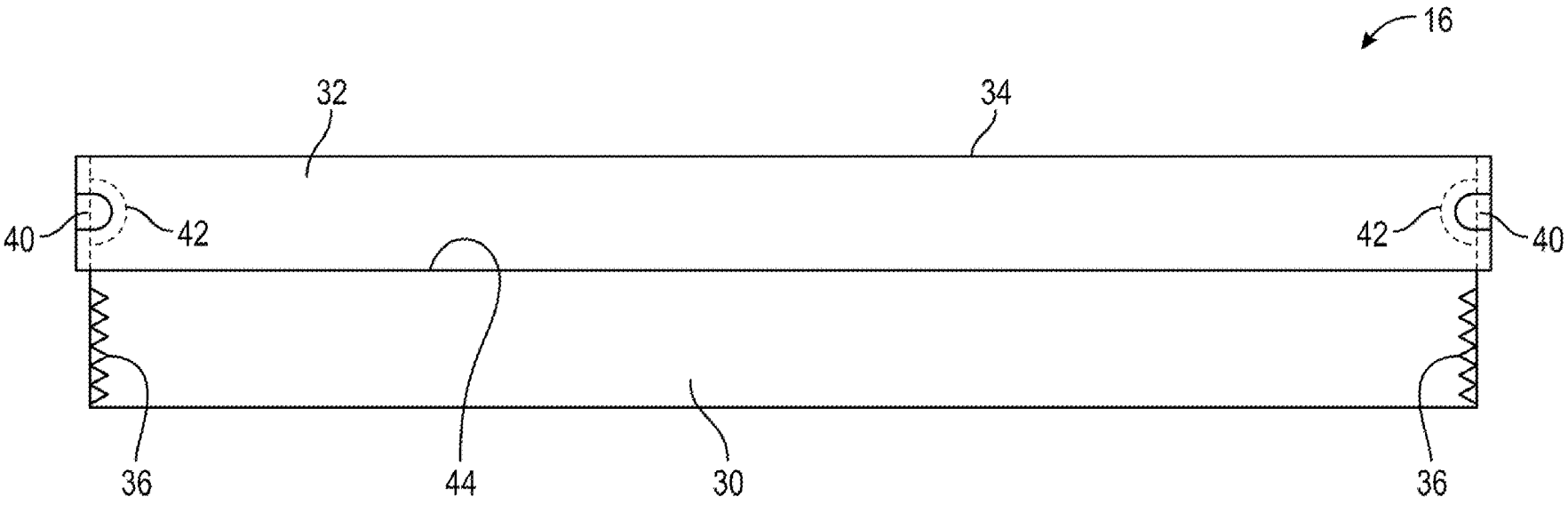
FIG. 4 is a view of FIG. 3A taken along line 4-4, in accordance with features of the present invention.

FIG. 4 is a view of FIG. 3A taken along line 4-4. This is a detailed side view of the baffle 16, and shows a base 30 overlaid with a baffle cover 32. The baffle cover 32 is in rotatable communication with the base 30 and defines a first outwardly directed surface 34 defining the slots 17 depicted in FIGS. 3A-C. A first inwardly directed periphery 38 at the distal portion of the baffle cover may define an inward, radially extending protuberance 40 adapted to be received by a distal first outwardly directed periphery of the 30, which has concave indentations or regions 42 adapted to reversibly receive (e.g., in a snap-fit configuration) the protuberance 40

The base 30, which may be the heel end of the dryer nacelle, comprises a plurality of slots 19, which may or may not align longitudinally with the slots 17 of the baffle cover depending on the rotation position between the cover 32 and the base 30.

In instances where the base 30 is not integrally molded with the dyer nacelle 18 to form the heel, a second outwardly directed periphery of the base 30 situated at a proximal portion (relative to the first outwardly directed periphery) of the base 30 may define female threads 36 adapted to receive male threaded portions of peripheral, externally directed surfaces (not shown) of the heel end of the nacelle. Aside from threads, the base 30 may be reversibly attached to the nacelle 18 via a plurality of clips, bolt/nut configurations, hook and pile configurations, among other typical fastening means. This will allow different baffles or baffle-base constructs to be attached to the dryer.

The outwardly directed surfaces 34, 44 of the baffle cover 32 and base 30, respectively may contain printed indicia which becomes more or less apparent when the slots of the two substrates are rotated in and out of alignment.

It is to be understood that the above description is intended to be illustrative and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all sub ratios falling within the broader ratio.

One skilled in the art will also readily recognize that where members are grouped together in a common manner, such as in a Markush group, the present invention encompasses not only the entire group listed as a whole but each member of the group individually and all possible subgroups of the main group. Accordingly, for all purposes, the present invention encompasses not only the main group but also the main group absent one or more of the group members. The present invention also envisages the explicit exclusion of one or more of any of the group members in the claimed invention.

The embodiment of the invention which an exclusive property or privilege is claimed is defined as follows:

1. A hairdryer comprising;

an air intake aperture;

an air expulsion aperture;

a fan positioned between the air intake aperture and the air expulsion aperture; and a baffle comprising a baffle base and a baffle cover, wherein the baffle base comprises a plurality of first slots, the baffle cover comprises a plurality of second slots, and the baffle cover is rotatable relative to the baffle base;

wherein when the baffle cover is rotated relative to the baffle base, a flow cross section that is an overlapped area between the first slots and the second slots is changed, so as to regulate amount of air flowing out of the air expulsion aperture.

2. The hairdryer as recited in claim 1 wherein the baffle is provided at the air intake aperture.

3. The hairdryer as recited in claim 2 wherein speed of the fan is adjusted by rotation of the baffle cover relative to the baffle base.

4. The hairdryer as recited in claim 2 wherein indicia reversibly appear on an outwardly facing surface of the hairdryer when the baffle is actuated.

5. The hairdryer as recited in claim 2 wherein a heating element is positioned between the fan and the expulsion aperture.

6. The hairdryer as recited in claim 1 wherein the baffle cover comprises a fluted side surface.

7. The hairdryer as recited in claim 1 further comprising a brushless DC motor mechanically coupled to the fan.

8. The hairdryer as recited in claim 1, wherein the first and second slots are configured so that when the baffle cover is rotated to a first position relative to the baffle base, the first slots align with the second slots, respectively.

9. The hairdryer as recited in claim 2, further comprising a nacelle that is in communication with the air intake aperture and the air expulsion aperture, wherein the air intake aperture is provided on the nacelle.

10. The hairdryer as recited in claim 2, further comprising:

a nacelle that is in communication with the air intake aperture and the air expulsion aperture; and a handle that is in communication with the nacelle, wherein the air intake aperture is provided on the handle.

* * * * *